United States Patent [19]

Ross et al.

[11] Patent Number: 4,505,015

[45] Date of Patent: Mar. 19, 1985

[54] BALANCED FORCE ROLLER

[75] Inventors: John P. Ross, Cupertino; Carl E. Bernardi, San Jose, both of Calif.

[73] Assignee: National Semiconductor Corporation, Santa Clara, Calif.

[21] Appl. No.: 399,616

[22] Filed: Jul. 19, 1982

[51] Int. Cl.[3] ..... B21B 13/02

[52] U.S. Cl. ..... 29/116 R; 29/110

[58] Field of Search ..... 29/116 R, 116 AD, 113 AD, 29/125, 110; 100/162 B; 403/116, 97; 464/112, 136

[56] References Cited

FOREIGN PATENT DOCUMENTS 730924 6/1955 United Kingdom ..... 29/116 R

*Primary Examiner*—Carl E. Hall
*Assistant Examiner*—John T. Burtch
*Attorney, Agent, or Firm*—Paul J. Winters; Michael J. Pollock; Gail W. Woodward

[57] ABSTRACT

A roller, for guiding strips of material, that can tilt in one plane with respect to a support shaft located inside the roller but is carefully prevented from moving out of the one plane by separate guides, also inside the roller, which separate guides are independent of the clearances needed in the bearing that allows tilting.

2 Claims, 2 Drawing Figures

BALANCED FORCE ROLLER

BACKGROUND OF THE INVENTION

The high speed intermittent movement of metal strip, for example, the metal strip used to form lead frames for integrated circuit chips, requires rollers that contact the strip with a fairly high contact force. It is practically impossible to prevent such rollers from deforming the strip a little. This being the case, it is necessary to insure that equal rolling pressure is applied on all parts of the strip, so that all parts are elongated by the same amount. Without this force balance, one side of the strip becomes slightly longer, creating a curve in the strip. Accordingly, prior art rollers are usually mounted on adjustable supports, sometimes with springs, so that the rolling force may be continuously adjusted to keep the strip from assuming a curve or warp.

Experience has shown that a great deal of time and effort is consumed in providing adjustments to keep the roller force balanced along its length. The present invention saves this time and effort by providing a roller that is self balancing so as to automatically maintain an even balanced force along the length of the rolling surface.

SUMMARY OF THE INVENTION

This invention contemplates a roller that can pivot about an internal pivot pin. As long as the strip passes over the roller at a location approximately centered over the pivot pin, the roller rocks back and forth, as needed, so as to perfectly and automatically balance the force applied across the width of the strip.

The roller is carried on bearings which ride on a bearing support. The bearing support has holes in it which receive the pivot pin. The pivot pin mounts on central support. The pivot pin necessarily engages the holes in the bearing support with a bit of clearance so as to allow unrestricted rotation about the pivot pin. The clearance, in turn, means that the roller can move out of alignment with its intended axis of rotation. This misalignment, even if slight, can radically alter the distribution of force across the length of the roller. Consequently, this invention contemplates two additional pins mounted on the central support that are oriented orthogonally to the pivot pin and also engage holes in the bearing support so as to keep the roller properly aligned. Hence, the roller is free to tilt, but in one exact plane only, so as to balance forces across the strip evenly and precisely.

DESCRIPTION OF THE PREFERRED EMBODIMENT

Figure 1:
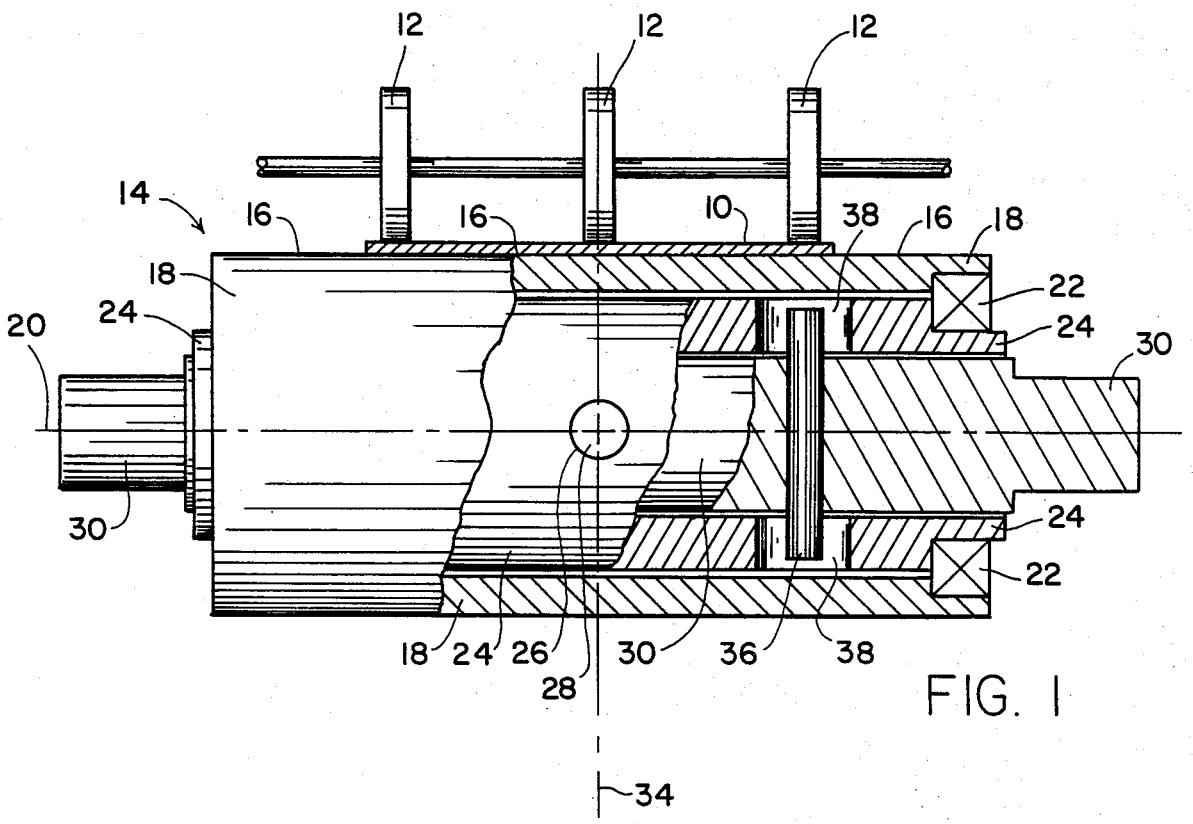
FIG. 1 is an elevational side view of the roller assembly of this invention, shown in position to hold a strip of metal between a set of opposing rollers and itself, with portions of the outer components partially cut away to reveal the inner components.

A strip of metal 10 is seen in cross section in FIG. 1, passing between a set of three idler rollers 12 and the balanced force roller 14 of this invention. A balanced force rolling surface 16 is provided by the outside of a cylindrical roller surface member 18 that rotates about a rotation axis 20. Cylinder 18 is carried at each end by a bearing 22. Bearings 22 rest on the ends of a bearing support 24. Support 24 has a pair of holes 26 therein that receive a pin 28. Pin 28 extends out from, and is mounted through, a central support member 30 disposed along axis 20.

Figure 2:
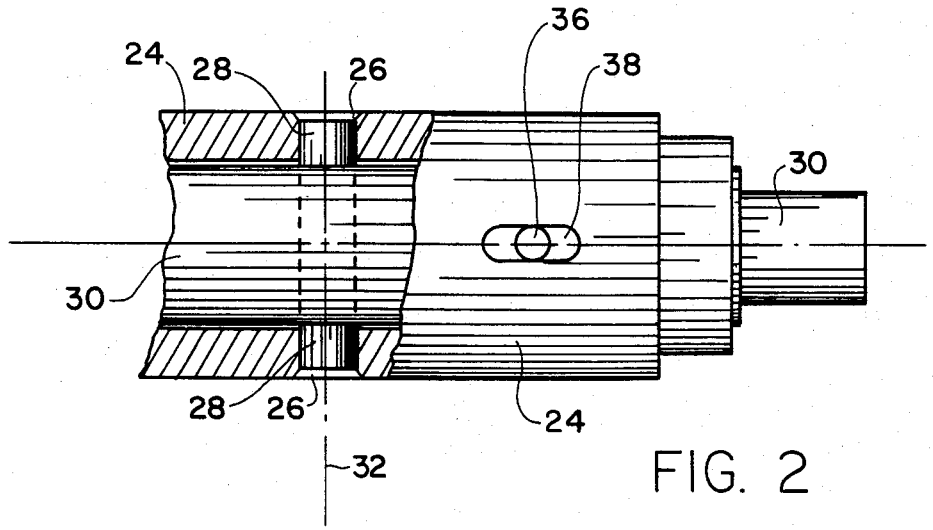
FIG. 2 is a fragmentary, partially cut-away, view of just the inner components, as seen from above in FIG. 1.

Simultaneous reference to the detail of FIG. 2 will be helpful at this point. Bearing support 24 can rotate about pin 28 and about the pivot axis 32 that extends down the center of pin 28. Thus, if strip 10 passes over roller 14 in a position approximately centered with respect to pin 28, the bearing support 24 can tilt about pin 28 as necessary to balance the forces applied to surface 16 on one side of pin 28 with the forces applied to surface 16 on the other side of pin 28.

Roller 14 is normally supported at the smaller diameter ends of central support member 30 by any conventional means. Since pivot axis 32 needs to be positioned beneath the center of the surface 16, bearing support 24 must extend within surface 16 at least far enough to engage pin 28 at a more or less central location. This central location may be identified by an alignment axis 34 that is orthogonal to, and passes through the intersection of, the rotational axis 20 and the pivot axis 32. Alignment axis 34 divides the rolling surface 16 in half and strip 10 would normally be located about half on one side of axis 34 and half on the other side.

If bearing support 24 is to be free to rotate easily about pin 28, it is necessary to provide some clearance between pin 28 and support 24. This clearance unavoidably allows bearing support 24 to rotate slightly about alignment axis 34 as well. When this happens, the line of contact between rollers 12 becomes slightly misaligned with respect to rotation axis 20. The forces along surface 16 may therefore change substantially because the curved surfaces of rollers 12 and surface 16 change their relative spacing immediately upon any slight differential movement about axis 34. The central roller 12 would then be applying considerably more force to surface 16 than the end rollers 12. To prevent this sort of misalignment, an additional alignment pin 36 is mounted nearer the end of central support 30 so as to project into an opening 38 in bearing support 24. Opening 38 is elongated so as to not restrict the rotation of bearing support 24 about pivot pin 28. However, pin 36 rests snugly against the sides of opening 38 so that bearing support 24 is prevented from rotating at all about axis 34. Hence, cylindrical roller 18 is maintained in strict horizontal alignment with rotation axis 20 even though it may tilt out of vertical alignment with rotation axis 20.

Many variations are possible without departing from the scope and spirit of the invention. The preferred embodiment utilizes another pin 36 at the other end of central support 30, which is not visible in the drawings, to help maintain zero relative rotation about alignment axis 34. But, of course, any means that projects from central support 30 into engagement with bearing support 24 at a location displaced from the centrally positioned alignment axis 34 may be substituted for the pins 36. Similarly, the type of bearing between support 24 and roller 18 can vary widely, bearings 22 representing only a preferred design. Central support 30 need not pass entirely through the roller provided it has some portion located centrally within the roller. Therefore, we intend to be limited only to the appended claims.

We claim:

1. A roller for providing balanced forces along the surface of the roller which surface is parallel to the axis of rotation of the roller comprising:

a generally cylindrical roller surface member having an axis of rotation and adapted to provide a balanced force rolling surface on the outside;

bearing support means disposed within said surface member at least to the extent of being located centrally with respect to the length along said axis of said balanced force rolling surface;

bearing means on said bearing support means adapted to carry said rolling surface in rotational movement about said axis of rotation;

a support member disposed along said axis of rotation;

a pivot bearing means extending from said support member to said bearing support means, said pivot bearing means located centrally with respect to the length of said balanced force rolling surface along said axis, said pivot bearing means having a pivot axis that extends orthogonally relative to said axis of rotation of said roller, and said bearing support means being rotatable about said pivot axis on said pivot bearing means; and alignment projection means extending from said support member, in a direction substantially orthongonal to both the axis of rotation and said pivot axis, into engagement with said bearing support means so as to maintain alignment of said surface member with said axis of rotation during rotation of said bearing support means about said pivot axis.

2. The roller of claim 1 in which said pivot bearing means comprises a cylindrical pin mounted on said support member, said cylindrical pin extending into opposed holes in said bearing support means so that the bearing support means may rotate on and about said cylindrical pin, and in which said alignment projection means comprises at least one other cylindrical pin mounted on said support member extending into opposed guide holes in said bearing support means, said guide holes shaped to allow said other cylindrical pin to move therein so as to permit the rotation of the bearing support means about the pivot axis but prevent rotation of the bearing support means about an alignment axis which is orthogonal to both the pivot axis and axis of rotation and intersects the pivot axis and axis of rotation.

* * * * *